US008800657B2

(12) United States Patent
Mazyar et al.

(10) Patent No.: US 8,800,657 B2
(45) Date of Patent: Aug. 12, 2014

(54) SEALING SYSTEM, METHOD OF MANUFACTURE THEREOF AND ARTICLES COMPRISING THE SAME

(75) Inventors: Oleg Antonovych Mazyar, Houston, TX (US); Michael H. Johnson, Katy, TX (US); Casey L. Walls, Philadelphia, PA (US)

(73) Assignee: Baker Hughes Incorporated, Houston, TX (US)

( * ) Notice: Subject to any disclaimer, the term of this patent is extended or adjusted under 35 U.S.C. 154(b) by 351 days.

(21) Appl. No.: 13/221,480

(22) Filed: Aug. 30, 2011

(65) Prior Publication Data

US 2013/0048289 A1 Feb. 28, 2013

(51) Int. Cl.
*E21B 33/12* (2006.01)

(52) U.S. Cl.
USPC ..... 166/300; 166/65.1; 166/179; 166/376; 166/387; 277/341; 419/8

(58) Field of Classification Search
None
See application file for complete search history.

(56) References Cited

U.S. PATENT DOCUMENTS

| | | | | |
|---|---|---|---|---|
| 4,157,732 | A * | 6/1979 | Fonner | 166/376 |
| 4,270,761 | A * | 6/1981 | Hertz, Jr. | 277/336 |
| 8,028,756 | B2 * | 10/2011 | Corre et al. | 166/387 |
| 8,261,841 | B2 * | 9/2012 | Bailey et al. | 166/380 |
| 8,499,843 | B2 * | 8/2013 | Patel et al. | 166/387 |
| 2004/0031605 | A1 | 2/2004 | Mickey | |
| 2007/0181224 | A1 * | 8/2007 | Marya et al. | 148/400 |
| 2008/0015578 | A1 | 1/2008 | Erickson et al. | |
| 2008/0071357 | A1 | 3/2008 | Girton et al. | |
| 2008/0105438 | A1 * | 5/2008 | Jordan et al. | 166/376 |
| 2008/0135249 | A1 | 6/2008 | Fripp et al. | |
| 2008/0149351 | A1 * | 6/2008 | Marya et al. | 166/387 |
| 2009/0301635 | A1 * | 12/2009 | Corre et al. | 156/84 |
| 2010/0206553 | A1 * | 8/2010 | Bailey et al. | 166/244.1 |
| 2010/0209288 | A1 * | 8/2010 | Marya | 420/541 |
| 2011/0067889 | A1 * | 3/2011 | Marya et al. | 166/386 |

OTHER PUBLICATIONS

International Search Report for PCT/US2012/05206, International filing date Aug. 23, 2012; Mailing date Jan. 31, 2013—3 pages.

* cited by examiner

*Primary Examiner* — George Suchfield
(74) *Attorney, Agent, or Firm* — Cantor Colburn LLP

(57) ABSTRACT

Disclosed herein is an apparatus for use downhole comprising an expandable component; a support member that has a selected corrosion rate; wherein the support member is disposed on the expandable component; where the support member comprises a plurality of particles fused together; the particles comprising a core comprising a first metal; and a first layer disposed upon the core; the first layer comprising a second metal; the first metal having a different corrosion potential from the second metal; the first layer comprising a third metal having a different corrosion potential from the first metal.

22 Claims, 2 Drawing Sheets

SEALING SYSTEM, METHOD OF MANUFACTURE THEREOF AND ARTICLES COMPRISING THE SAME

BACKGROUND

1. Field of the Disclosure

This disclosure relates to intermetallic metallic composites, methods of manufacture thereof and articles comprising the same.

2. Background of the Related Art

In performing underground operations such as, for example oil and natural gas exploration, carbon dioxide sequestration, exploration and mining for minerals such as iron, uranium, and the like, exploration for water, and the like, it is often desirable to first drill a borehole that penetrates into the formation.

Once a borehole has been drilled, it is desirable for the borehole to be completed before minerals, hydrocarbons, and the like can be extracted from it. A completion involves the design, selection, and installation of equipment and materials in or around the borehole for conveying, pumping, or controlling the production or injection of fluids into the borehole. After the borehole has been completed, the extraction of minerals, oil and gas, or water can begin.

Sealing systems, such as packers, are commonly deployed in a borehole as completion equipment. Packers are often used to isolate portions of a borehole from one another. For example, packers are used to seal the annulus between a tubing string and a wall (in the case of uncased or open hole) or casing (in the case of cased hole) of the borehole, isolating the portion of the borehole uphole of the packer from the portion of the borehole downhole of the packer.

Sealing systems that isolate one portion of the borehole from another portion of the borehole generally employ an expandable component and a support member. The support member protects the expandable component until the expandable component is expanded in the borehole to effect the isolation. In order to expand the expandable component, it is desirable to first remove the support member. Removing the support member at the wrong rate can result in improper isolation of one part of the borehole from another. It is therefore desirable to use a support member that can be removed in a controlled fashion when desired.

SUMMARY OF THE DISCLOSURE

Disclosed herein is an apparatus for use downhole comprising an expandable component; a support member that has a selected corrosion rate; wherein the support member is disposed on the expandable component; where the support member comprises a plurality of particles fused together; the particles comprising a core comprising a first metal; and a first layer disposed upon the core; the first layer comprising a second metal; the first metal having a different corrosion potential from the second metal; the first layer comprising a third metal having a different corrosion potential from the first metal.

Disclosed herein too is a method comprising disposing a layer of a second metal upon a particle that comprises a first metal; where the first metal has a different corrosion potential from the second metal; disposing a third metal upon the second metal; the third metal having a different corrosion potential from the first metal; and sintering the particles to form a billet.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF EMBODIMENTS

Disclosed herein is a support member for a sealing system that comprises an alloy manufactured from particles of a first metal upon which is disposed a layer of a second metal. The particles generally comprise a core that contains the first metal. Disposed upon the core is a first layer that contains the second metal. Additional particles that comprise a third metal may be optionally disposed in either the core or the first layer to further control the electrolytic decomposition of the support member.

When the support member contacts borehole fluids, the interaction of the borehole fluid with the support member causes electrolytic reactions to take place between the core and the first layer, thus causing decomposition of the support member. By controlling the composition of the alloy, the rate of decomposition can be controlled, so that deployment of an expandable component can be facilitated when desired. The function of the expandable component will be discussed in detail later.

The sealing system also comprises a auxiliary electrode that can be made to selectively contact the support member when desired and that can cause the support member to function as either a cathode or an anode during downhole operations. The support member can be made to contact the support member in order to facilitate additional control of rate of electrolytic decomposition of the support member.

Figure 1:
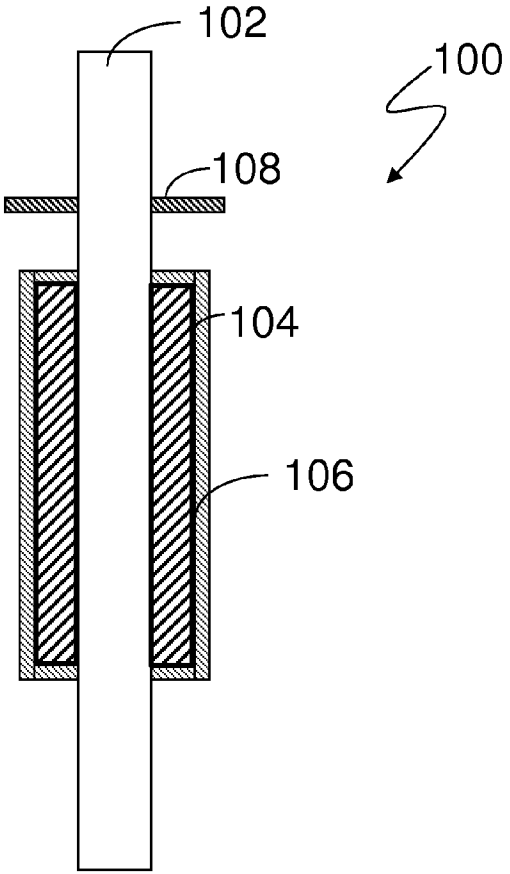
FIG. 1 is a depiction of a sealing system that has a single auxiliary electrode.

FIG. 1 is a depiction of an exemplary sealing system 100. The sealing system 100 is disposed around a tubing string 102 and comprises an expandable component 104 and a support member 106. The support member 106 supports and protects the expandable component 104 during the introduction of the tubing string 102 into the borehole and prevents the expandable component 104 from being deployed or being degrading prior to the point at which it has to be utilized. The sealing system 100 also comprises an auxiliary electrode 108 that can be selectively displaced to reversibly contact the support member 106 for a desired time period. By having the auxiliary electrode 108 reversibly contact the support member 106, further control can be exerted over the electrolytic decomposition of the support member 106. It is to be noted that since the tubing string 102 is manufactured from an electrically conductive metal, the support member 106 and the auxiliary electrode 108 are electrically insulated from the tubing string 102. The electrical insulation (not shown) prevents electrical contact between the between the support member and the auxiliary electrodes when contact is not desired.

When the tubing string 102 has reached the point in the borehole at which it is to be used, the support member 106 is electrolytically degraded in a controlled manner from the sealing system 100 and the expandable component 104 is subjected to expansion to isolate one portion of the borehole from another portion of the borehole.

In order to effect the desired use of the expandable component 104, the removal of the support member 106 has to be accomplished under controlled conditions. It is therefore desirable to have a support member 106 manufactured from a material that can be removed in a controlled fashion so that the swelling of the expandable component 104 can be brought about at the desired time to isolate one portion of the borehole from another.

The support member 106 is manufactured from an alloy or from an intermetallic compound that comprises particles having a core upon which is disposed a first layer. When the support member contacts a borehole fluid, the core and the first layer form an electrolytic cell that leads to the dissolution of the support member. In other words, if the core functions as an anode upon contacting the borehole fluid, then the first layer functions as a cathode and vice versa. The third metal that is added to the particles functions to expedite or reduce the rate of dissolution of the support member 106.

The first metal and the second metal may comprise transition metals, alkali metals, alkaline earth metals, or combinations thereof so long as the first metal is not the same as the second metal. The first metal may comprise aluminum, magnesium, zinc, copper, iron, nickel, cobalt, or the like, or a combination comprising at least one of the foregoing metals. The second metal may comprise aluminum, magnesium zinc, copper, iron, nickel, cobalt, or the like, or a combination comprising at least one of the foregoing metals so long as it is has a different corrosion potential from the first metal. The third metal may comprise nickel, zinc, copper, iron, cobalt, tungsten, or the like, or a combination comprising at least one of the foregoing metals so long as it has a different corrosion potential from the first metal. In one embodiment, the third metal has a different corrosion potential from the first metal and from the second metal. The differences in "corrosion potential" refers to differences in galvanic behavior between different materials when exposed to the same electrolytes under identical conditions. More specifically it refers to the ability of different metals to corrode at different rates when exposed to the same electrolytes under identical conditions. The first metal, the second metal and the third metal should be different from each other and should specifically be different metals from the galvanic series.

In one exemplary embodiment, the first metal comprises aluminum, while the second metal comprises magnesium. The third metal may comprise nickel.

In another exemplary embodiment, the first metal comprises magnesium, while the second metal comprises aluminum. The third metal may comprise nickel.

The first metal is present in an amount of about 85 to about 95 wt %, specifically about 87 to about 93 wt %, based upon the total weight of the support member 106. The size of the core particle and the thickness of the first layer may be used to control the rate of dissolution when the borehole fluid contacts the support member. By adjusting the composition of the first layer relative to the core and the second layer, and by adjusting the amounts and/or thicknesses of the first and the second layers, the corrosion rate of the composite particle is adjusted. It will further be appreciated that additional control of the corrosion rate is accomplished by the degree of inter-dispersion of the core, the first layer and the second layer, where the more highly inter-dispersed these layers are, the greater the corrosion rate, and conversely, the less inter-dispersed the layers, the slower the corrosion rate. It will be understood that amount and thickness as used herein are related in that the higher the amount of a layer, expressed as weight percent based on the weight of the composite particle, the greater the thickness. The average particle size of the core is about 70 to about 150 micrometers, specifically about 80 to about 130 micrometers, and more specifically about 90 to about 120 micrometers. The particle size refers to the diameter of the core of the particle.

In an exemplary embodiment, the first metal is magnesium and is present in an amount of about 85 to about 95 wt %, specifically about 87 to about 93 wt %, based upon the total weight of the support member 106.

The second metal is present in an amount of about 5 to about 15 wt %, specifically about 7 to about 13 wt %, based upon the total weight of the support member 106. The average particle size of the core with the first layer second metal is about 80 to about 200 micrometers, specifically about 90 to about 170 micrometers, and more specifically about 100 to about 150 micrometers. The particle size refers to the diameter of the particles.

In an exemplary embodiment, the second metal is aluminum and is present in an amount of about 5 to about 15 wt %, specifically about 7 to about 13 wt %, based upon the total weight of the support member 106. In another exemplary embodiment, the second metal comprises aluminum with a small amount of a metal oxide disposed thereon. The metal oxide can be aluminum oxide, silicon oxide, titanium dioxide, zirconium oxide, or the like, or a combination comprising at least one of the foregoing metal oxides. In an exemplary embodiment, the metal oxide is alumina ($Al_2O_3$). The amount of the alumina is about 0.1 to about 4 wt %, specifically about 0.3 to about 3.5 wt %, and more specifically 0.4 to about 2.5 wt %, based upon the total weight of the support member 106.

The third metal serves as a dopant and is used to control the rate of dissolution of the core and the first layer. In one embodiment, the addition of the third metal to the alloy provides the ability to develop local cells within the alloy that can be used to control the rate of dissolution on a local scale. In another embodiment, the third metal forms a solution with the second metal to provide an alloy that is used to form the first layer. The boundaries between the core, the first layer and the second layer can contain alloys in the form of intermetallic composites. In other words, the surface of the particles includes both anodic and cathodic regions that comprise inter-dispersed regions. It will be understood that "anodic regions" and "cathodic regions" are relative terms, based on the relative activity of the inter-dispersed materials. For example, the magnesium (from the core) is anodic relative to the cathodic intermetallic compound of the interlayer (e.g., a magnesium-aluminum intermetallic alloy). Similarly, when the first layer comprises aluminum, it is anodic relative to nickel from the cathodic second layer. Similarly, the magnesium-aluminum intermetallic alloy is anodic relative to cathodic aluminum from the first layer, and anodic relative to nickel from the second layer. The electrolytic properties of this solution can be varied by changing the composition of the first layer to control the rate of electrolytic activity of the core and the first layer. In other words, when magnesium is used as the core in the particles, all other elements would be acting as cathodes with respect to the core. This is true whether the particles are in the form of an alloy or an intermetallic composition.

In an exemplary embodiment, the third metal is present only in the first layer of the particles. An exemplary third metal is nickel. The third metal is present in an amount of 100 parts per million (ppm) to about 0.25 wt %, specifically about 150 ppm to about 750 ppm and more specifically about 175 to about 500 ppm, based upon the total weight of the support member 106.

In one embodiment, in one method of manufacturing the support member 106, particles of the first metal (i.e., the core) are coated with a layer of the second metal. Particles of the third metal may be added to the second metal either during the disposing of the second metal onto the core or immediately following the disposing of the second metal onto the core.

In one embodiment, the layer of second metal may be disposed upon the first metal (core) by techniques involving vapor deposition. Examples of suitable techniques for disposing the second layer include chemical or physical vapor deposition.

Chemical vapor deposition includes atmospheric chemical vapor deposition, low pressure chemical vapor deposition, ultrahigh vacuum chemical vapor deposition, aerosol assisted vapor deposition, direct liquid injection chemical vapor deposition, microwave plasma assisted chemical vapor deposition, remote plasma enhanced chemical vapor deposition, atomic layer chemical vapor deposition, hot wire (hot filament) chemical vapor deposition, metal organic chemical vapor deposition, combustion chemical vapor deposition, vapor phase epitaxy, rapid thermal chemical vapor deposition, hybrid physical chemical vapor deposition, or a combination comprising at least one of the foregoing processes. If combinations of the foregoing chemical vapor deposition processes are used, they may be employed simultaneously or sequentially.

Physical vapor deposition includes cathodic arc deposition, electron beam physical vapor deposition, evaporative deposition, pulsed laser deposition, sputter deposition or a combination comprising at least one of the foregoing processes. If combinations of the foregoing physical vapor deposition processes are used, they may be employed simultaneously or sequentially. Combinations of physical vapor deposition processes and chemical vapor deposition processes may also be used.

Following the deposition of the second metal on the first metal (i.e., the core), the third metal may also be disposed upon the second metal. The particles are then subjected to cold isostatic pressing, hot isostatic pressing, spark plasma sintering, or combinations thereof to form an article. The article is generally termed a "billet". The billet may then be subjected to forging and/or extrusion. Cold isostatic pressing is performed at around room temperature (23° C.) and at pressures of about 10 to about 50 kilopounds per square inch (ksi) to form a billet. Following the cold isostatic pressing, the billet is subjected to forging and/or extrusion. Hot isostatic pressing may also be performed on the particles at elevated temperatures and pressures to form a billet. Hot isostatic pressing is performed at a temperature of about 300 to about 500° C., specifically about 350 to about 450° C. The pressure during the hot sintering is about 1,000 to about 2,000 pounds per square inch, specifically about 1,250 to about 1,750 pounds per square inch. Following the hot isostatic pressing, the billet is subjected to forging and/or extrusion. Spark plasma sintering may also be used to form a billet. Following the spark plasma sintering, the billet is subjected to forging and/or extrusion. In an exemplary embodiment, hot isostatic pressing is used to form the billet.

Following sintering, the billet is machined to the desired shape to form the support member 106. An exemplary form of machining to form the support member 106 is forging.

As noted above, the auxiliary electrode 108 can be a part of the sealing system 100. When the auxiliary electrode 108 serves as an anode to the support member 106 (which functions as a cathode), the auxiliary electrode 108 is termed a sacrificial electrode. For example in the FIG. 1, if it is desirable to accelerate the corrosion of the support member 106 when the assembly has reached a desired location downhole, the auxiliary electrode 108 will function as a cathode. In this event, the support member 106 serves as the anode and undergoes corrosion. If, on the other hand, it is desirable to preserve the support member 106 from the premature corrosion during its transportation to the point of deployment, then the auxiliary electrode 108 should serve as the anode and undergoes corrosion. The term "sacrificial electrode" is therefore used to describe the auxiliary electrode 108 since it is sacrificed to preserve the support member 106.

The auxiliary electrode 108 can thus comprise two electrodes (a first auxiliary electrode 108A and a second auxiliary electrode 108B), one of them functions as a sacrificial electrode depending upon conditions downhole. This is depicted in the FIG. 2. Both the first and the second auxiliary electrodes 108A and 108B can be repositioned along the tubing string 102 and can be brought into contact with the support member 106 when desired. They can also be removed from contact with the support member 106 when desired.

When a single auxiliary electrode 108A is used, the single component can function only as an anode or as a cathode with respect to the support member 106. However, when two auxiliary electrodes 108A and 108B are used, the composition of the first electrode 108A can be selected such that it can function as an anode (i.e., the sacrificial electrode 108A) with respect to the support member 106, while the composition of the second electrode 108B can be selected such that it can function as a cathode with respect to the composition of the support member 106. By contacting the support member 106 with the auxiliary electrodes 108A and 108B either sequentially or simultaneously, the rate of dissolution can be controlled to facilitate the deployment of the expandable component only when desired. Since the auxiliary electrodes 108A and 108B are repositionable, they can be made to contact the support member 106 to either expedite the rate of dissolution or to slow it down. As noted above, since the tubing string 102 is manufactured from an electrically conductive metal, the support member 106 and the auxiliary electrodes 108A and 108B are electrically insulated from the tubing string 102. The electrical insulation (not shown) prevents electrical contact between the between the support member and the auxiliary electrodes when contact is not desired.

Figure 2:
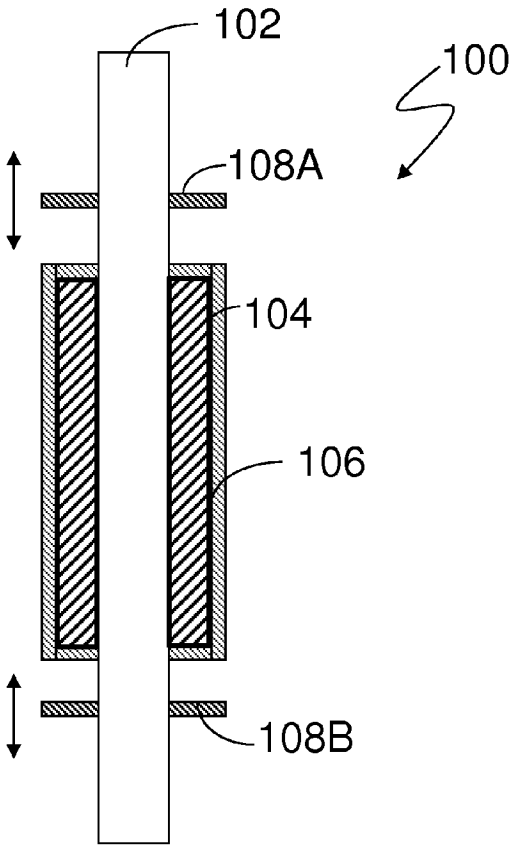
FIG. 2 is a depiction of an exemplary sealing system that has two auxiliary electrodes.

In one embodiment, in one manner of using the auxiliary electrodes shown in FIG. 2, the auxiliary electrodes 108 function to protect the support member 106 from corrosion during its trip to a place of deployment. Prior to reaching a point of deployment, the first auxiliary electrode 108A contacts the support member 106. The first auxiliary electrode 108A functions as an anode with respect to the support member 106, thus preventing the support member 106 form undergoing dissolution in the borehole fluids. Once the assembly has reached its destination, the auxiliary electrode 108A (i.e., the "sacrificial anode") is displaced from contacting the support member 106 and the second auxiliary electrode 108B (now a cathode with respect to the support member 106) is brought into contact with the support member 106 to promote corrosion and dissolution of the support member 106. In one embodiment, instead of moving the auxiliary electrodes 108, 108A, and 108B, each of them can be in electrical communication with the support member 106 via an electrically conductive (i.e. copper) wire having on/off switches. Thus, instead of moving one of the auxiliary electrodes to the support member 106, the corresponding switch may be turned on, which establishes an electrical contact between the selected auxiliary electrode and the support member. The wire may be coated with an electrically insulating material (e.g., polymers or a ceramic) that prevents it from corroding in the borehole environment.

In one embodiment, in one method of manufacturing the sealing system 100, an optional first auxiliary electrode 108B is disposed on a tubing string 102. Following this, the expandable component 104 and the support member 106 are disposed on the tubing string 102. The expandable component

104 comprises an elastomer that can be expanded upon contact with borehole fluids. In one embodiment, the expandable component 104 is a shape memory alloy that can expand to its original shape upon the application of a stimulus (e.g., a changing of the temperature). In yet another embodiment, the expandable component is a screen manufactured from an open cell shape memory foam and is disposed around the tubing string in its compressed form. This is termed a "conformable sand screen". When in its compressed state, the conformable sand screen can be delivered to the place of deployment. At the place of deployment, the conformable sand screen expands to its original shape and contacts the walls of borehole. To compress the shape memory foam, its temperature is increased to be proximate to its glass transition temperature. Decreasing the temperature afterwards keeps the foam "frozen" in its compressed form. High temperature and/or wellbore fluids may activate the expansion of the shape memory foam before the screen is delivered to the required place.

The second auxiliary electrode 108A is then disposed on the tubing string 102. The first and the second auxiliary electrodes 108A and 108B are in contact with a device (not shown) that can be used to facilitate a repositioning of these electrodes on the tubing string.

In one embodiment, in one method of using the sealing system 100, the tubing string 102 with the sealing system 100 disposed thereon is then lowered into a borehole. As the borehole fluids contact the support member 106, electrolytic cells are set up in the support member 106, which cause the support member to begin to dissolve. By contacting the support member 106 with the auxiliary electrodes 108A and 108B, the dissolution can be controlled to effect a desired rate of dissolution until the sealing system 100 is positioned at a location in the borehole where the expandable component 104 can be deployed. At this point, the support member 106 can be entirely dissolved and the swellable component 104 can be deployed.

This invention may be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross sectional illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The transition term "comprising" is inclusive of the transition terms "consisting of" and "consisting essentially of".

All numerical ranges included herein are interchangeable and are inclusive of end points and all numerical values that lie between the endpoints.

As used herein a "borehole" may be any type of well, including, but not limited to, a producing well, a non-producing well, an experimental well, an exploratory well, a well for storage or sequestration, and the like. Boreholes may be vertical, horizontal, some angle between vertical and horizontal, diverted or non-diverted, and combinations thereof, for example a vertical borehole with a non-vertical component.

The term "support member" refers to a device that supports the expandable component and the tubing string. The "support member" may also function to protect, guard and/or shield the expandable component from damage prior to its removal.

The term "expandable" as used in the "expandable component", can encompass a variety of means by which the expansion can occur. The expansion can occur for example, through swelling, inflation via pressure, thermal expansion, and the like, or a combination thereof. Some expandable components may be actuated by hydraulic pressure transmitted either through the tubing bore, annulus, or a control line. Other expandable components may be actuated via an electric line deployed from the surface of the borehole. Furthermore, some expandable components have been used that employ materials that respond to the surrounding borehole fluids and borehole to form a seal.

While the invention has been described in detail in connection with a number of embodiments, the invention is not limited to such disclosed embodiments. Rather, the invention can be modified to incorporate any number of variations, alterations, substitutions or equivalent arrangements not heretofore described, but which are commensurate with the scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus for use downhole comprising:

an expandable component;

a support member that has a selected corrosion rate; wherein the support member is disposed on the expandable component; where the support member comprises:

a plurality of particles fused together; the particles comprising:

a core comprising a first metal; and a first layer disposed upon the core; the first layer comprising a second metal; the first metal having a different corrosion potential from the second metal; the first layer comprising a third metal having a different corrosion potential from the first metal.

2. The apparatus of claim 1, further comprising a first auxiliary electrode; the first auxiliary electrode being operative to reversibly contact the support member to change the corrosion rate.

3. The apparatus of claim 1, where the first metal is aluminum, magnesium, zinc, copper, iron, nickel, cobalt, or a combination comprising at least one of the foregoing metals.

4. The apparatus of claim 1, where the second metal is aluminum, magnesium, zinc, copper, iron, nickel, cobalt, or a combination comprising at least one of the foregoing metals.

5. The apparatus of claim 1, where the first metal is magnesium.

6. The apparatus of claim 1, wherein the second metal is aluminum.

7. The apparatus of claim 6, wherein the second metal has a metal oxide disposed thereon.

8. The apparatus of claim 1, wherein the third metal is nickel, zinc, copper, iron, cobalt, tungsten, or a combination comprising at least one of the foregoing metals.

9. The apparatus of claim 8, where the third metal is nickel.

10. The apparatus of claim 1, where the first metal comprises about 85 to about 95 wt % of the total weight of the support member.

11. The apparatus of claim 1, where the second metal comprises about 5 to about 15 wt % of the total weight of the support member.

12. The apparatus of claim 1, where the third metal comprises about 0.01 parts per million to about 0.25 wt % of the total weight of the support member.

13. The apparatus of claim 2, further comprising a second auxiliary electrode that reversibly contacts the support member.

14. The apparatus of claim 2, where the first auxiliary electrode is anodic with respect to the support member.

15. The apparatus of claim 2, where the second auxiliary electrode is cathodic with respect to the support member.

16. The apparatus of claim 1, where the third metal has a different corrosion potential from the second metal.

17. A method comprising:

disposing upon a tube string, a sealing system; the sealing system comprising:

an auxiliary electrode, an expandable component and a support member;

wherein the support member comprises:

a plurality of particles fused together; wherein the particles comprise:

a core comprising a first metal; and a first layer disposed upon the core; the first layer comprising a second metal and a third metal; the first metal having a different corrosion potential from the second metal;

introducing the tube string into a well; and dissolving the support member.

18. The method of claim 17, further comprising swelling the expandable component.

19. The method of claim 17, wherein a rate of dissolution of the support member is controlled.

20. The method of claim 17, further comprising reversibly contacting the support member with the auxiliary electrode.

21. The method of claim 17, where the expandable component comprises a shape memory alloy that returns to an original shape upon being subjected to a stimulus.

22. The method of claim 17, where the expandable component comprises a shape memory open cell foam that returns to an original shape upon being subjected to a stimulus.

* * * * *